US005713722A

United States Patent [19]

Correia et al.

[11] Patent Number: 5,713,722

[45] Date of Patent: Feb. 3, 1998

[54] TURBINE NOZZLE AND RELATED CASTING METHOD FOR OPTIMAL FILLET WALL THICKNESS CONTROL

[75] Inventors: Victor H. Correia, New Lebanon; Theresa A. Brown; Daniel R. Predmore, both of Clifton Park, all of N.Y.

[73] Assignee: General Electric Co., Schenectady, N.Y.

[21] Appl. No.: 667,157

[22] Filed: Jun. 20, 1996

Related U.S. Application Data

[62] Division of Ser. No. 542,001, Oct. 12, 1995.

[51] Int. Cl.[6] ..... F01D 5/14

[52] U.S. Cl. ..... 416/241 R; 415/200

[58] Field of Search ..... 415/200; 416/241 R, 416/241 B

[56] References Cited

U.S. PATENT DOCUMENTS

| | | | |
|---|---|---|---|
| 3,981,344 | 9/1976 | Hayes et al. . | |
| 4,285,634 | 8/1981 | Rossman et al. | 416/241 B |
| 4,323,394 | 4/1982 | Hoffmuller et al. | 416/241 B |
| 5,247,984 | 9/1993 | Stanciu . | |
| 5,295,530 | 3/1994 | O'Connor et al. . | |
| 5,489,194 | 2/1996 | Yoshinari et al. | 416/241 R |

*Primary Examiner*—John T. Kwon

*Attorney, Agent, or Firm*—Nixon & Vanderhye

[57] ABSTRACT

In a method of investment casting a turbine nozzle which includes an outer band, an inner band and an airfoil section extending between the inner and outer bands, an improvement including shaping a temporary wax form, and external shell and internal core components used in casting such that during pouring of molten metal into a space created by removal of the wax form, shell material lies on opposite sides of an outer fillet connecting the outer band to the airfoil section. The resulting gas turbine nozzle includes first and second horizontally oriented ribs extending about interior peripheries of the airfoil section vertically adjacent the outer and inner band fillets.

2 Claims, 4 Drawing Sheets

Fig. 1 *(PRIOR ART)*

Fig. 2 *(PRIOR ART)*

TURBINE NOZZLE AND RELATED CASTING METHOD FOR OPTIMAL FILLET WALL THICKNESS CONTROL

This is a divisional of co-pending application Ser. No. 08/542,001 filed on Oct. 12, 1995.

TECHNICAL FIELD

This invention relates to the casting of turbine nozzles for both power generation as well as aircraft gas turbine engine applications.

BACKGROUND

Typically, in the turbine section of gas turbine engines, turbine nozzles (also referred to as vane airfoils) are positioned forward of rotating buckets, and are utilized to direct hot combustion gases at an optimal angle to cause the buckets to efficiently rotate, which, in turn, produces power used to turn a shaft which, in the case of a gas turbine for power generation applications, may be connected to a generator for the production of electricity.

Gas turbine nozzles are typically hollow metal structures and are manufactured using the investment casting process. Current methods of investment casting of gas turbine nozzles include shaping the nozzle airfoil component in wax by enveloping a conventional alumina or silica based ceramic core which defines internal coolant passages of the nozzle. The wax assembly then undergoes a series of dips in liquid ceramic solution. The part is allowed to dry after each dip, forming a hard external shell, typically a conventional zirconia based ceramic shell. After all dips are complete, and the wax assembly is encased by several layers of hardened ceramic shell, the assembly is placed in a furnace where the wax in the shell is melted out. The remaining mold consists of the internal ceramic core, the external ceramic shell, and the space between the core and the shell, previously filled by the wax. The mold is again placed in the furnace, and liquid metal is poured into an opening at the top of the mold. The molten metal enters the space between the ceramic core and the ceramic shell, previously filled by the wax. After the metal is allowed to cool and solidify, the external shell is broken and removed, exposing the metal nozzle component which has taken the shape of the void created by removal of the wax, and which encases the internal ceramic core. This nozzle component is then placed in a leeching tank, where the ceramic core is dissolved. The metal nozzle component now has the shape of the wax form, and an internal cavity which was previously filled by the internal ceramic core.

The relative thermal growths of the ceramic shell and the ceramic core material are different, so that after the metal has been poured and is allowed to cool, the relative shrinking of the shell and core components are different. This can cause varying wall thicknesses at areas of the metal nozzle part where one side of the wall is defined by the external shell, and the other side of the wall is engaged by the internal core. In particular, and as explained in greater detail below, the region where the airfoil forms a fillet with the outer nozzle band has traditionally been a very difficult region in which to control casting wall thicknesses.

In FIG. 1, a typical turbine nozzle is shown at 10. The nozzle is comprised of an airfoil section 12, an outer nozzle band 14, an inner nozzle band 16, an inner mounting flange 18, an inner airfoil fillet 20A where the airfoil section 12 meets the inner nozzle band 16, an outer airfoil fillet 20B where the airfoil section 12 meets the outer nozzle band 14 (see FIG. 2), internal airfoil ribs 22, and an outer mounting hook 24. The turbine nozzle also has an outer vertically oriented collar 26B around the periphery of the airfoil section on the side of the outer nozzle band opposite the airfoil section 12 and at the interface between the fillet 20B and the outer nozzle band 14. A similar inner collar 26A is formed at the interface between the fillet 20A and the inner nozzle band 16.

With reference now also to FIG. 2, the nozzle 10 is shown with the internal alumina or silica based ceramic core 28 and the external zirconia based shell 30 as they would appear after pouring of the molten metal into the space previously described above. It should be pointed out here, however, that the nozzle as shown in FIG. 2 has the same shape as the temporary wax form and, therefore, surfaces or shapes of the temporary wax form correspond to identical shapes or surfaces of the metal nozzle. Accordingly, references herein to either the wax form or the resulting metal nozzle structure are, in effect, interchangeable. For example, the horizontally oriented ribs 26A and B are initially formed in wax and later formed by the molten metal poured into the space vacated by the wax. This is also true with respect to FIGS. 3 and 4 as described further herein.

Note that the core 28 has enlarged ends 32 (at the fixed end of the nozzle which is intended to be firmly attached in the turbine) and 34 (at the free end). At the "fixed end", there is little or no relative expansion between the ceramic core and shell. At the "free end", however, such relative expansion readily occurs. In the process of preheating the mold prior to metal pouring, and in cooling the mold after metal pouring, the external shell 30 and internal core 28 grow and shrink at different rates due to different material properties of the two ceramic materials. The wall thickness of the outer and inner bands 14 and 16, respectively, is not affected by this relative growth phenomena, since both sides of the metal bands are engaged by the same external shell material which, of course, has uniform thermal growth properties. Relatively consistent wall thickness in the areas of the inner and outer bands are therefore readily obtainable.

The thickness dimensions at the inner band wall fillet 20A is affected to only a minor, insignificant extent, since the shell and core are held to each other at this end, i.e., the "fixed end". There is thus a smaller distance over which the relative growth can occur, and as a result, the absolute relative growth is much smaller in comparison to the area opposite the fixed end.

In the region where the airfoil forms the fillet 20B with the nozzle outer band, i.e., at the "free end", however, the different growth and shrink rates readily occur, and it is here that differential thermal expansion significantly affects the wall thickness dimension. This region generally tends to be one of the areas of high stress and low part life, making it a critical region where wall thickness control is essential.

DISCLOSURE OF THE INVENTION

It is the principal objective of this invention to reduce the relative differences in thermal expansions of the core and shell material in the region where the airfoil forms a fillet with the outer nozzle band.

In an exemplary embodiment, the vertical collar around the periphery of the fillets at the outer band interface is eliminated and is replaced with an internal horizontally oriented flash rib. While the re-design is more critical at the outer fillet, it may be incorporated at both the inner and outer fillets. More specifically, to reduce the relative differences in thermal expansions of the core and shell ceramic materials, the position of the core can be placed so as to direct the inevitable relative motion in a direction such that minimal wall thickness change occurs as is observed in the airfoil wall. In other words, to desensitize the outer fillet to the relative growth and shrink differences between the core and shell, the peripheral vertical collar is replaced by the above described horizontal internal flash rib, and the shell ceramic material is extended over the fillet. As a result, external shell material engages and envelopes both sides of the outer fillet, providing for a well controlled, consistent thickness in this critical region.

In order to take up the relative growth of the core and the shell, the flash rib is created within the airfoil section at a location aligned with the tangency point of the fillet and the airfoil. This feature is achieved by redesign of the internal mold core and the wax form so that the wax form includes horizontally oriented flash ribs (in place of the prior art vertically oriented collars). The new configuration is completed by the dipping process which forms the external shell, as described above. After the wax is removed, molten metal is poured into the void left by the wax, including the spaces which create the flash ribs. Any relative motion between the core and shell will be taken out by a variation in the thickness of one or both of the flash ribs instead of the fillets. After casting, the flash ribs can be machined out or used as a mounting seat for impingement inserts which generally are placed in the nozzle airfoils for cooling purposes as is well known in the art.

In accordance with its broader aspects therefore, the present invention relates to a method of investment casting a turbine nozzle which includes an outer band, an inner band and an airfoil section extending between the inner and outer bands, the improvement comprising shaping a temporary wax form and external shell and internal core components used in casting such that during pouring of molten metal into a space created by removal of the wax form, similar external shell material lies on opposite sides of an outer fillet where the outer band meets the airfoil section.

In another aspect, the invention relates to a gas turbine nozzle comprising an outer band and an inner band; an airfoil section extending between the outer band and the inner band with an outer band fillet radius and an inner band fillet, respectively therebetween; and a first horizontally oriented rib extending about an interior periphery of the airfoil section, below and adjacent the outer band fillet.

Additional objects and advantages of the subject invention will become apparent from the detailed description which follows.

BEST MODE FOR CARRYING OUT THE INVENTION

Figure 1:
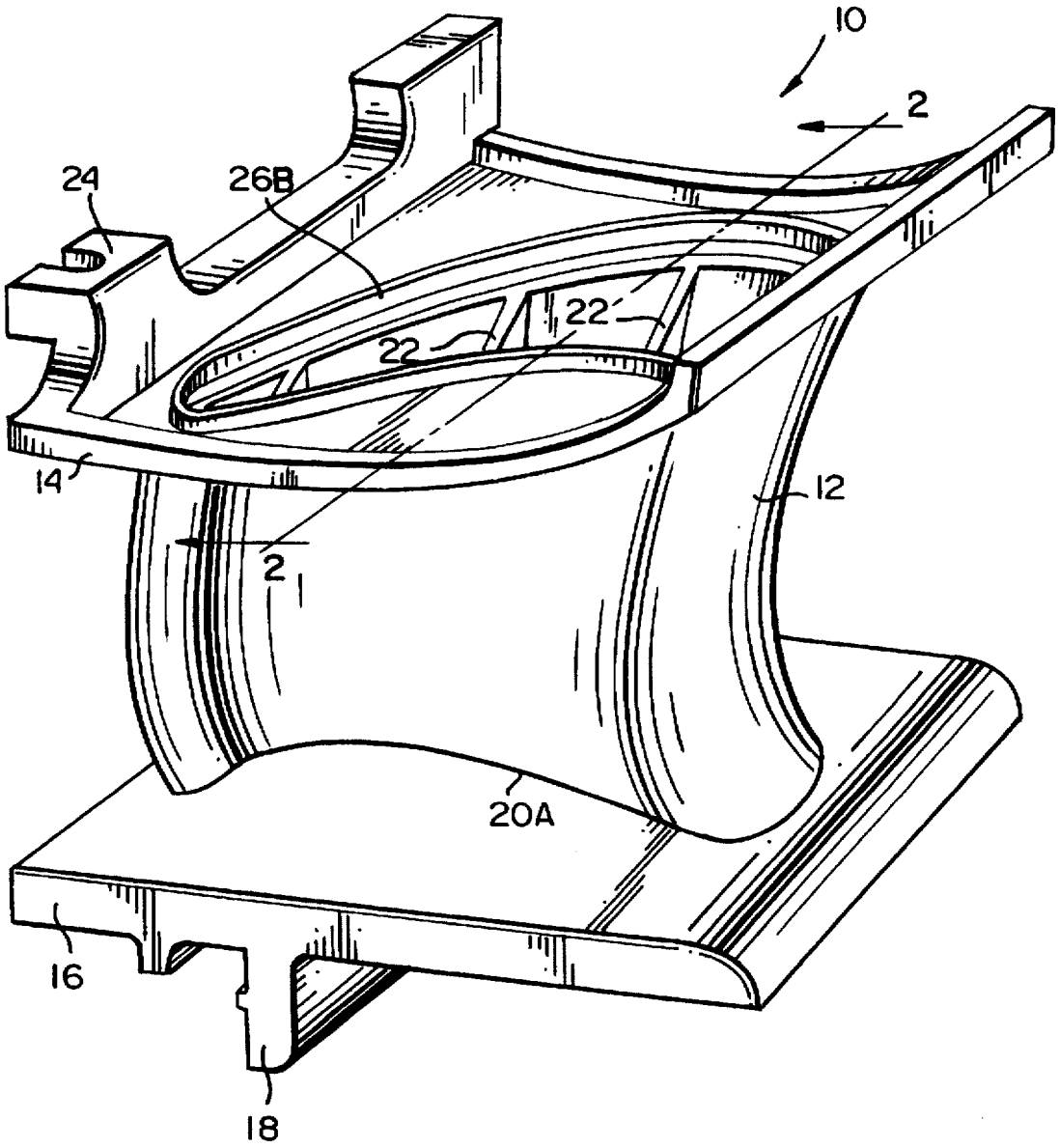
FIG. 1 is a perspective view of a conventional prior art gas turbine nozzle.
Figure 2:
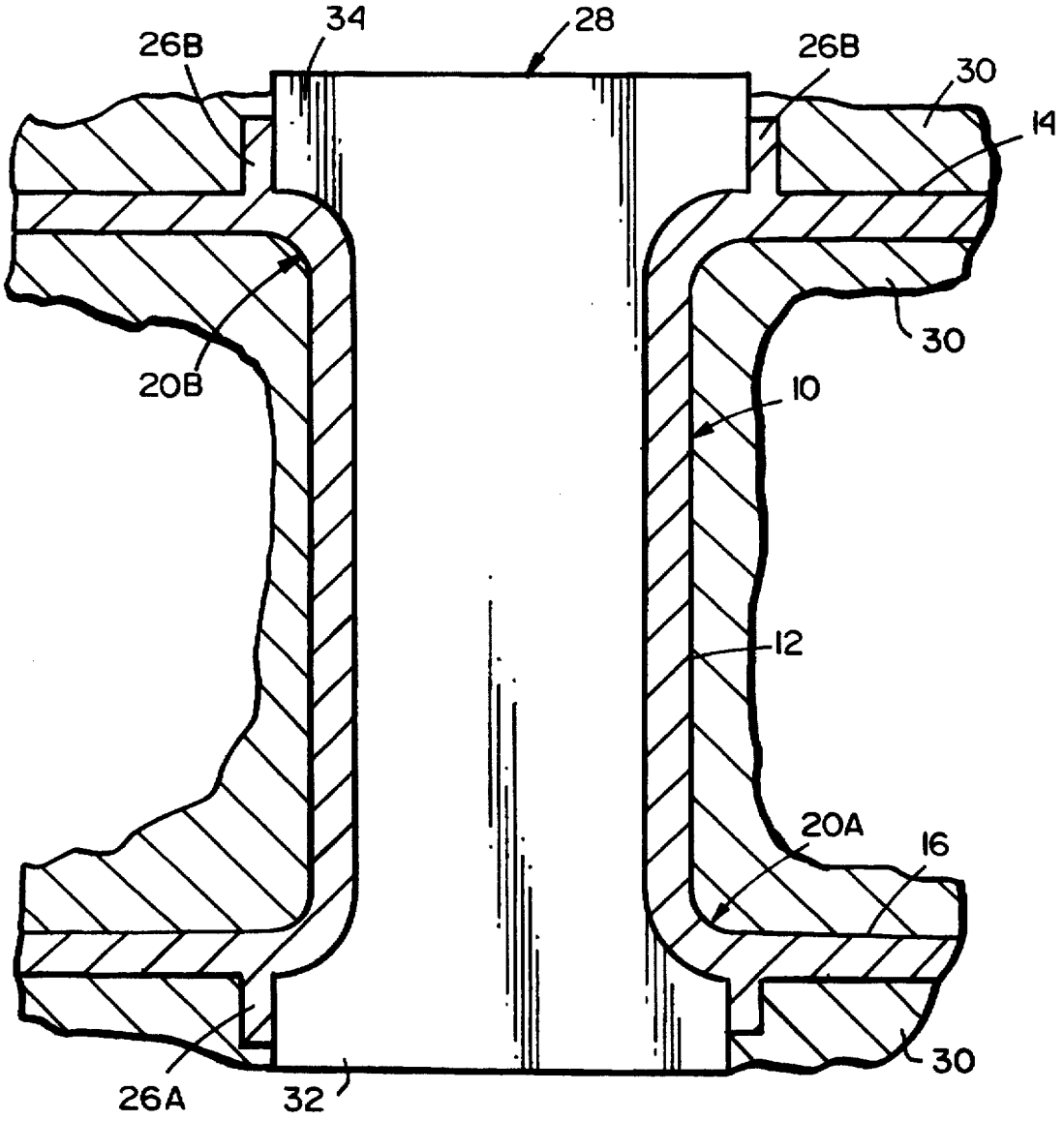
FIG. 2 is a cross sectional view taken along the line 2—2 of FIG. 1.
Figure 3:
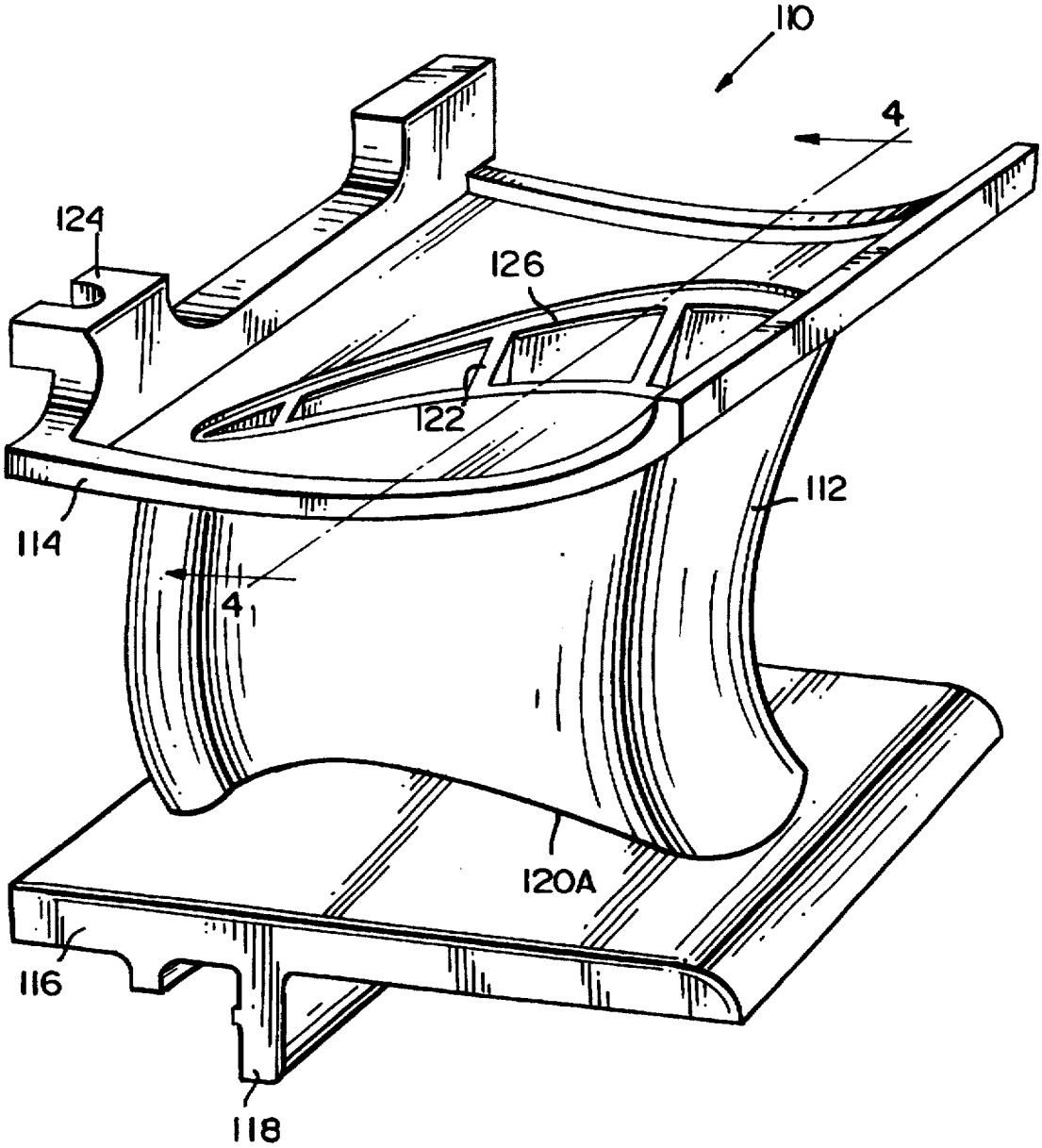
FIG. 3 is a perspective view of a gas turbine incorporating the subject matter of this invention.
Figure 4:
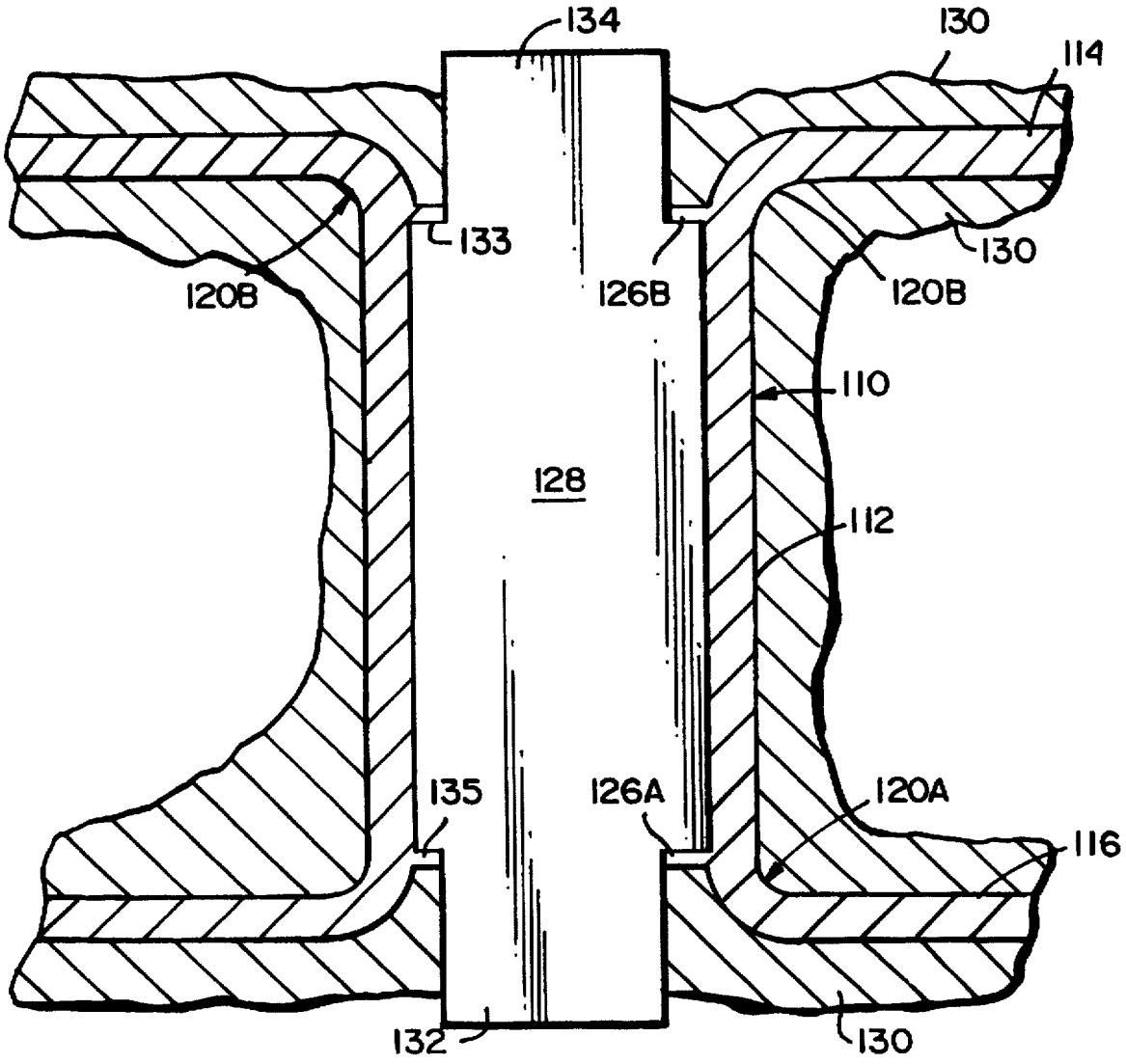
FIG. 4 is a cross sectional view taken along the line 4—4 of FIG. 3.

Referring now to FIGS. 3 and 4, the gas turbine nozzle and mold configuration are shown which incorporate the features of this invention. For convenience, reference numerals utilized in FIGS. 1 and 2 are utilized for corresponding components in FIGS. 3 and 4, but with a prefix "1" added. Thus, and with specific reference to FIG. 3, the turbine nozzle 110 includes an airfoil section 112, an outer band 114, an inner band 116, an inner mounting flange 118, an inner airfoil fillet 120A, an outer airfoil fillet 120B, internal airfoil ribs 122 and an outer mounting hook 124. In this embodiment, the peripheral collars 26A and 26B have been eliminated in favor of horizontally oriented flash ribs 126A and 126B which are located within the internal cavity of the nozzle airfoil, below the level of the outer band 114, and above the level of inner band 116, respectively, as best seen in FIG. 4.

In order to achieve the above configuration, the internal ceramic core 128 has been reconfigured to have reduced size end portions 132 and 134 as best seen in FIG. 4. When the wax form is added to the ceramic core, the wax form includes the horizontally oriented wax flash ribs 126A and 126B which engage horizontal shoulders 135 and 133, respectively, of the internal ceramic core. During subsequent dipping steps which form the external shell 130, the latter will engage the wax flash ribs and will fill the space on either side of the upper band 114 and lower band 116 and the reduced ends 132 and 134 of the internal ceramic core as clearly shown in FIG. 4.

It should be noted here that the materials forming the internal core 128 and external shell 130 may be the same alumina or silica based ceramic and zirconia based ceramic, respectively, as used in the prior process. These are well known, commercially available materials typically used in investment casting. The invention here, however, is not limited to the use of these specific materials.

With the above described arrangement, it will be appreciated that, after the wax is melted out of the mold, and upon pouring of molten metal into the void space previously filed by the wax, like material (external shell material) will engage and surround opposite sides of the upper band 114 and the lower band 116. In this way, the inner fillet 120A and the outer fillet 120B (and especially the outer fillet 120B), will have a more controllable, and thus more uniform, wall thickness because the fillets have been desensitized to the relative growth and shrink differences between the core and the shell ceramics.

After casting, the metal flash ribs 126A and 126B can be machined out of the part, or they can be used as a mounting seat for impingement inserts, typically placed in the nozzle airfoils for cooling purposes as is well known in the art.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A gas turbine nozzle comprising an outer band and an inner band; an airfoil section extending between the outer band and the inner band with an outer band fillet and an inner band fillet, respectively therebetween; and a first horizontally oriented rib extending about an interior periphery of the airfoil section, below and adjacent said outer band fillet.

2. The gas turbine nozzle of claim 1 and further comprising a second horizontally oriented rib extending about the interior periphery of the airfoil section, above and adjacent said inner band fillet.

* * * * *